US007997207B2

(12) United States Patent
Hess

(10) Patent No.: US 7,997,207 B2
(45) Date of Patent: Aug. 16, 2011

(54) RAILWAY JOINT CONNECTION ARRANGEMENT

(75) Inventor: Wilfried Hess, Gaildorf (DE)

(73) Assignee: Stahl CraneSystems GmbH, Kunzelsau (DE)

( * ) Notice: Subject to any disclaimer, the term of this patent is extended or adjusted under 35 U.S.C. 154(b) by 163 days.

(21) Appl. No.: 12/517,669

(22) PCT Filed: Nov. 20, 2007

(86) PCT No.: PCT/EP2007/010021

§ 371 (c)(1),
(2), (4) Date: Aug. 20, 2009

(87) PCT Pub. No.: WO2008/067906

PCT Pub. Date: Jun. 12, 2008

(65) Prior Publication Data

US 2010/0019055 A1 Jan. 28, 2010

(30) Foreign Application Priority Data

Dec. 8, 2006 (DE) ..... 10 2006 058 422

(51) Int. Cl.
*B61B 3/00* (2006.01)

(52) U.S. Cl. ..... 104/95; 104/106; 104/107; 104/111; 105/148; 105/150; 105/154

(58) Field of Classification Search ..... 104/89, 104/92, 93, 95, 106, 107, 109, 111; 105/148, 105/150, 154
See application file for complete search history.

(56) References Cited

U.S. PATENT DOCUMENTS

| | | | | |
|---|---|---|---|---|
| 1,178,196 | A * | 4/1916 | Willard | 104/107 |
| 3,043,408 | A * | 7/1962 | Attwood | 52/842 |
| 3,987,877 | A * | 10/1976 | Bulanchuk | 191/23 A |
| 4,524,698 | A * | 6/1985 | Tourtellier et al. | 104/107 |
| 4,768,442 | A * | 9/1988 | Miller | 104/106 |
| 4,838,412 | A * | 6/1989 | Backman | 198/838 |
| 5,203,135 | A * | 4/1993 | Bastian | 52/848 |
| 5,392,987 | A * | 2/1995 | Ropers et al. | 238/10 E |
| 5,443,151 | A * | 8/1995 | Taylor | 198/860.1 |
| 5,598,785 | A * | 2/1997 | Zaguroli, Jr. | 104/111 |
| 6,283,038 | B1 * | 9/2001 | Mattila | 104/89 |
| 6,324,989 | B1 * | 12/2001 | Taylor et al. | 104/93 |
| 6,807,791 | B2 * | 10/2004 | Herb | 52/846 |
| 7,464,574 | B2 * | 12/2008 | Durney et al. | 72/324 |
| 7,584,703 | B2 * | 9/2009 | Wallner | 104/106 |

(Continued)

FOREIGN PATENT DOCUMENTS

CA 2260405 A1 7/2000

(Continued)

*Primary Examiner* — Joe Morano, IV
*Assistant Examiner* — Jason C Smith
(74) *Attorney, Agent, or Firm* — Leydig, Voit & Mayer, Ltd.

(57) ABSTRACT

A joint connector for the lower flanges of adjoining running rails is assembled from two abutment pieces that each is seated in a lower flange of a respective rail that forms the joint. By use of centering devices, the correctly aligned positioning of the two abutment pieces is assured, wherein the abutment pieces transfer their aligned positioning to the lower flanges that meet each other without offset at the joint and the positioning cannot be negatively affected by transverse forces. The connection also provides a positive-fit in a transverse direction of the rails. Another joint connector arrangement connects the two running rails in the region of the top side. Abutment pieces in this case are seated as riders on a support rib and are connected to each other by tension rods.

25 Claims, 4 Drawing Sheets

U.S. PATENT DOCUMENTS

| | | | | |
|---|---|---|---|---|
| 7,603,952 | B2 * | 10/2009 | Vetesnik | 104/106 |
| 7,784,627 | B2 * | 8/2010 | Birkigt et al. | 212/315 |
| 7,856,930 | B2 * | 12/2010 | Zaguroli, Jr. | 105/29.1 |
| 2009/0101039 | A1 * | 4/2009 | Zaguroli, Jr. | 104/106 |
| 2010/0019055 | A1 * | 1/2010 | Hess | 238/175 |
| 2010/0107918 | A1 * | 5/2010 | Hess | 104/93 |
| 2010/0282120 | A1 * | 11/2010 | Micheletti | 104/106 |

FOREIGN PATENT DOCUMENTS

| | | | |
|---|---|---|---|
| DE | 8409917 | U1 | 9/1984 |
| DE | 3401183 | A1 | 7/1985 |
| EP | 1031529 | A | 8/2000 |

* cited by examiner

RAILWAY JOINT CONNECTION ARRANGEMENT

CROSS-REFERENCE TO RELATED APPLICATIONS

This patent application is the national phase of PCT/EP2007/010021, filed Nov. 20, 2007, which claims the benefit of German Patent Application No. DE 102006058422.8, filed Dec. 8, 2006.

FIELD OF THE INVENTION

The present invention relates generally to a connector arrangement for connecting rails in adjoining and end-to-end relation to each other, and more particularly, to a connector arrangement for connecting joints in rails for overhead conveyors.

BACKGROUND OF THE INVENTION

In overhead conveyors, trolleys of hoists run on rails that are suspended from the ceiling. Continuous rails can be used for short distances. For longer distances, the rails must be divided for assembly and production-related reasons. Thus, the problem arises of connecting the individual rail sections at the joints so that the traveling trolley moves in jerk-free fashion across the rail joint.

Furthermore, the joint connector arrangement that bridges the rail joint must also transmit bending forces/torques introduced by the trolley traveling gear into the rail on one side of the joint to the other rail across the rail joint. Otherwise, a significant height offset would occur in the area of the rail joint. A lateral offset of the rails is also undesired because side guide wheels of the traveling gear could catch on these parts, or could bump against the resulting step.

The running rails of overhead conveyors typically have a somewhat I-shaped cross-sectional profile, wherein the upper and lower flanges usually have a hollow profile for weight and stability reasons. No connection devices could be mounted on the web connecting the two flanges, as the web is often used as a substructure for conductor lines.

A rail joint connector arrangement for overhead conveyors is known from DE 34 01 183 A1. Here, the running rails are assembled from two roll-formed halves, wherein the joint between the two rail parts runs through the center of the web. Thus, each half of the running rail carries one half of the upper flange and one half of the lower flange. In the area of the upper flange, there remains a continuous gap, while in the area of the lower flange, the halves are curled inward.

In the upper flange, there is a joint connector arrangement made from two abutment pieces screwed together by means of a tensioning bolt. In the lower flange, there are brackets seated in each chamber formed by the rolled profile that bridge the joint and are fixed in the chamber on either side of the joint by means of screws used as alignment pins. A disadvantage in this construction is that no biasing forces could be generated in the lower flange transverse to the separation plane of the joint.

At the upper flange, the abutment pieces in this location do not allow sufficient lateral centering. Centering by the tensioning bolt is usually not sufficient. In the area of the upper flange, this is relatively non-critical since the wheels of the trolley traveling winch do not run over this flange. The use of such a construction in the area of the lower flange would be inadequate since the centering or correctly positioned fixing of the two rail ends at the joint is not adequately assured.

OBJECTS AND SUMMARY OF THE INVENTION

It is an object of the present invention to provide a more effective arrangement for joining rails of an overhead conveyor in end-to-end relation to each other.

Another object is to provide a rail joint arrangement as characterized above which more effectively joins the rails for overhead conveyors having upper and lower hollow flanges separated by an intermediate section.

In carrying out the invention, the rail joint connector arrangement for the lower flange, two abutment pieces are provided that are introduced into the respective lower flanges which are constructed with a hollow profile. Thus, on either side of the rail joint, there is an abutment piece in the lower flange, and this is secured in the axial direction. Each abutment exhibits an end face pointing in the direction toward the rail joint. In the area of the two end faces, the abutment pieces are provided with centering means that guarantee an exactly aligned orientation of the abutment pieces, independent of the tensioning means. The lateral play that the abutment pieces have in the lower flange also is reduced.

Furthermore, tensioning means are provided to tension the two abutment pieces relative to each other. In this way, any gap at the rail joint in the area of the lower flange can be avoided. The running surface of the rail is thus smooth and continuous. Wear of the wheels of the trolley traveling gear thereby is reduced to a minimum and is not worsened by the rail joint.

Advantageously, the two abutment pieces can be identical to each other. The cross section of the abutment piece is adapted to the cross section of the hollow space in the lower flange. Advantageously, the abutment piece has the shape of a block with two lateral faces parallel to each other and two end faces parallel to each other.

If the running rail is made from a roll-formed sheet metal part, the corners of the hollow space are rounded in the lower flange. Consequently, it is useful for the abutment piece to have beveled edges.

For anchoring the abutment piece in the lower flange, the abutment piece has at least two boreholes in the side faces. The boreholes can be counterbored, threaded boreholes. The boreholes can be blind boreholes, or the two boreholes can be configured as through holes.

The attachment means for anchoring the abutment piece in the lower flange can include pins that are designed to be inserted through the side wall of the lower flange into the opening of the abutment piece. The pins can be screws, namely stud bolts or cap screws. They project by an amount beyond the edge surface of the abutment piece, wherein this amount is not greater than the wall thickness of the traveling rails in this area. In this way, a positive-fit attachment of the abutment piece in the lower flange is achieved, while, on the other hand, no parts project laterally beyond the lower flange.

In terms of production, the centering means can be effected very easily if they involve centering boreholes and alignment pins. Therefore, the abutment pieces can be formed easily and exactly on NC machines. Complicated milling work is eliminated.

The centering means can include, in each end face of an abutment piece, a borehole and a pressed-in alignment pin, such that the pressed-in alignment pin of one abutment piece can be inserted into the vacant mating hole of the other abutment piece and vice versa. To facilitate tensioning, each abutment piece can contain a continuous through hole. A tension rod that is constructed as a threaded rod/screw and that leads, in the assembled state, through the tensioning boreholes of both abutment pieces, can be part of the tensioning means. Here, a threaded rod should also be understood to be a long cap screw that is provided with appropriate threads on one end.

The tensioning means can also include a threaded borehole in each abutment, wherein the threads in one abutment piece are right-handed, and the threads in the other abutment piece are left-handed. The tension rod that pulls the two abutment pieces toward each other is a threaded rod that carries opposite-sense threads on its two ends that is provided, in the middle, with a projection enabling a tool to grip it.

The novel rail joint connector arrangement for the upper flange is designed to grip a support rib formed on the upper flange. A first abutment piece that is attachable on the support rib and located on one side of the rail joint is part of the rail joint connector arrangement. The abutment piece is anchored on the support rib with the help of attachment means. On the other side of the rail joint a second abutment piece is seated that is similarly arranged on the support rib and connected to the support rib. Tensioning means act between the two abutment pieces, and on both sides of the joint, to draw the two rails toward each other. Special centering means are not required in such case, because no rails run over the upper flange. Slight offsets in the vertical and lateral directions that remain despite the offset-free joining at the lower flange are harmless.

The abutment piece for the upper flange can have a channel that, in the assembled state, receives the support rib. The abutment piece can have two laterally projecting flanges with through holes. The tensioning means can have at least one threaded rod that extends between the two abutment pieces adjacent to the rib to draw the abutment pieces together.

Other objects and advantages of the invention will become apparent upon reading the following detailed description and upon reference to the drawings, in which:

Figure 1:
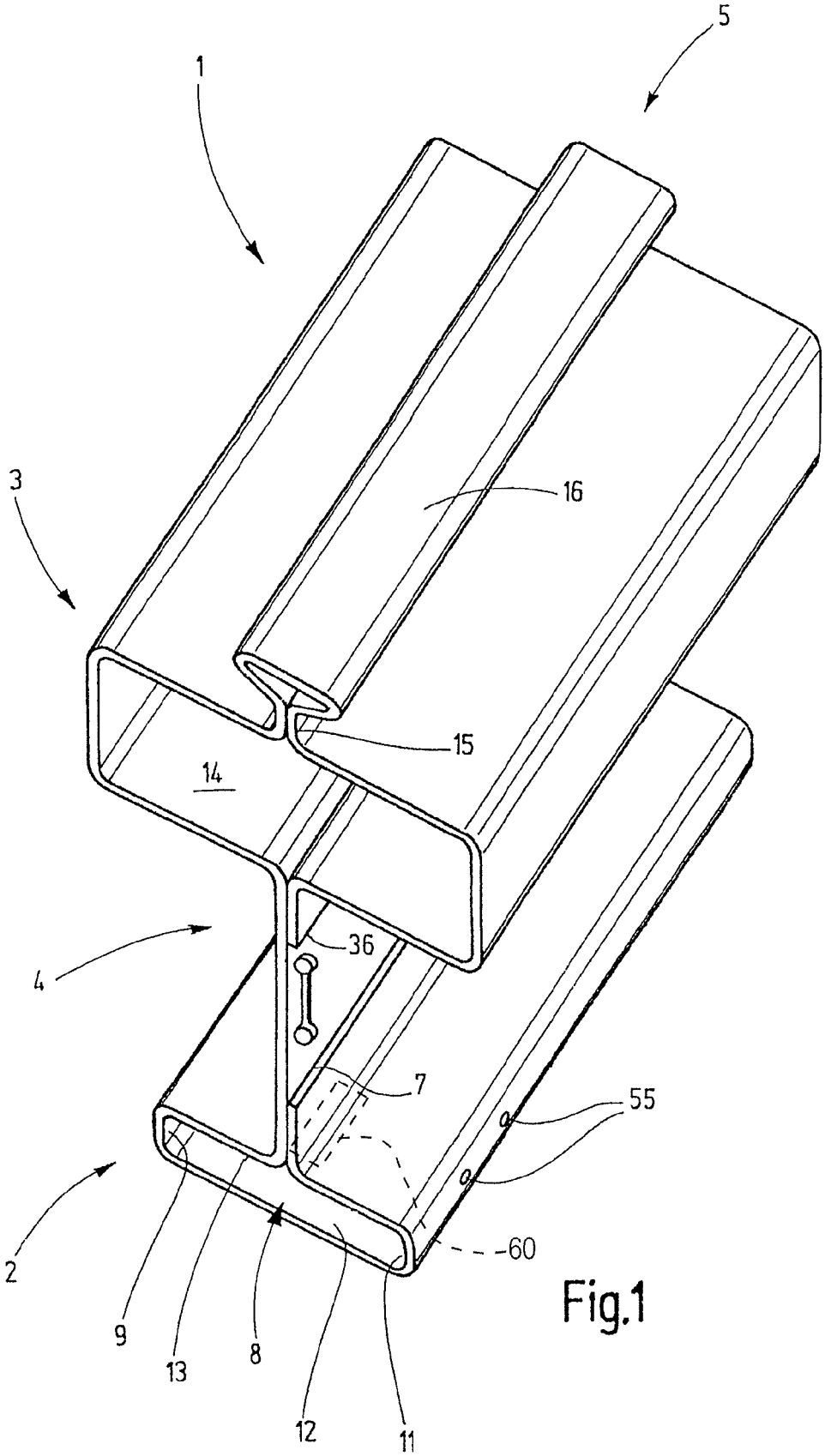
FIG. 1 is a perspective section of a typical crane rail having upper and lower hollow chamber flanges to which the present invention has particular applicability.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention. It will also be understood that the drawings are not absolutely to scale. For illustrating the essential details, certain areas may be shown disproportionately large. In addition, the drawings are simplified and do not contain every detail possible in practical implementation. The terms upper and lower refer to the normal installation position.

DESCRIPTION OF THE PREFERRED EMBODIMENTS

Referring now more particularly to FIG. 1 of the drawings, there is shown an illustrative running rail 1 for an overhead conveyor. The running rail 1 has a lower flange 2 and an upper flange 3. The upper and lower flanges 2, 3 are connected to each other by a web 4. On the top side of the upper flange 3, there is a support rib 5. The web 4 lies in the vertical plane of symmetry.

The entire running rail 1 has a constant cross section that is continuous over the length and made from a roll-formed steel plate whose edges 6, 7 are laser-welded to the web 4. As a result of the roll-formed profile, the lower flange 2 is formed as a hollow chamber that defines a hollow space 8 that is rectangular in cross section. The hollow space 8 is bounded by two narrow sides 9, 11 of the lower flange 2, a bottom side 12, and a top side 13 from the center of which the web 4 projects. The upper flange 3 is similarly constructed as a hollow chamber which defines a hollow space, also with a rectangular cross section.

The support rib 5 is composed of a bar-shaped web 15 and a hollow bulge 16 that is formed at the upper end of the bar-shaped web 15 and has a triangular cross section. The bar-shaped web 15 is straight, as can be seen in FIG. 1, and has a small height as compared with the web 4.

Figure 2:
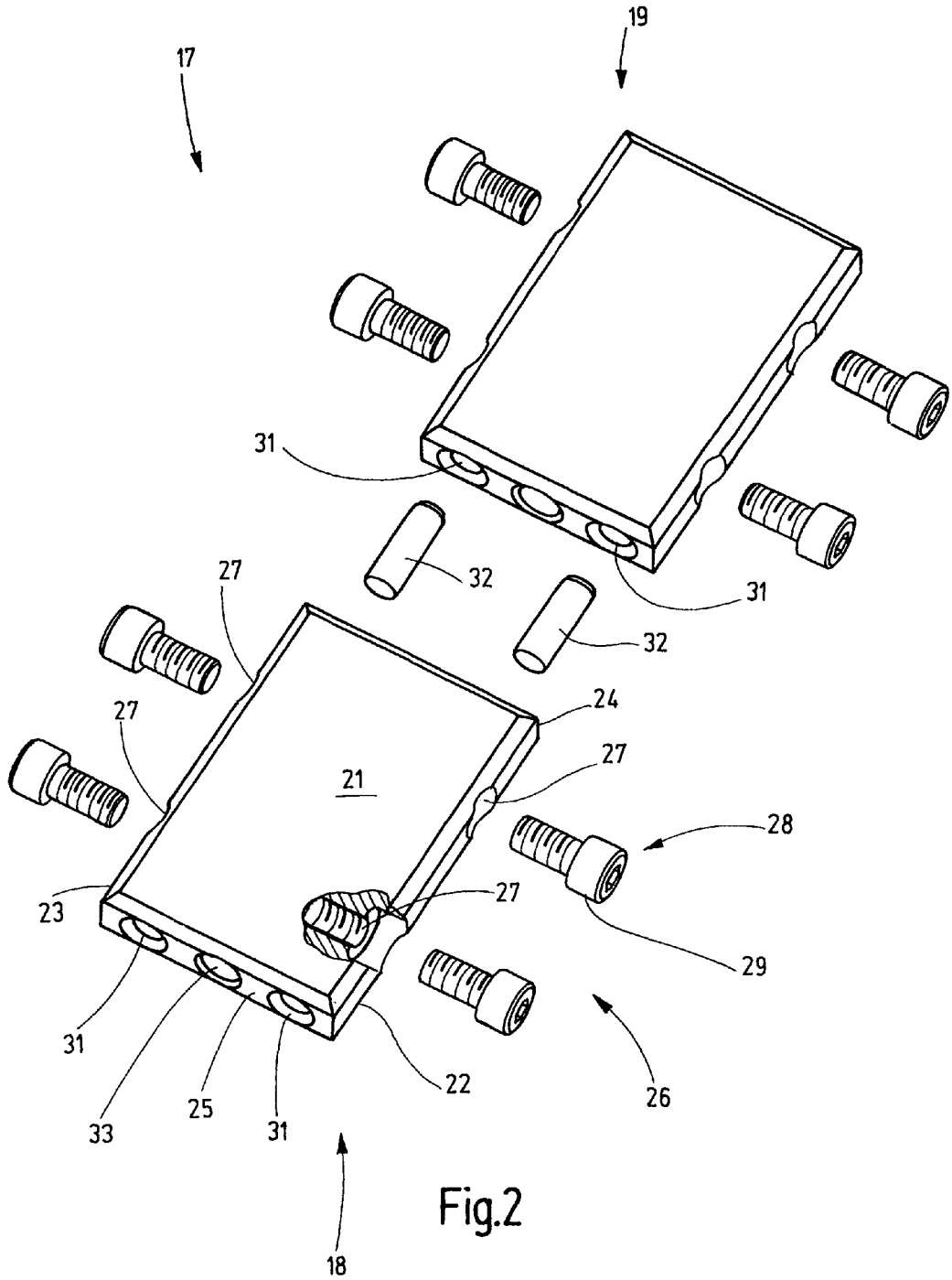
FIG. 2 is a perspective of a rail joint connector arrangement according to the invention for use in connecting the lower flanges of abutting rails.

In order to connect two running rails 1 of the profile shown in FIG. 1 at a joint between the rails, a joint connector arrangement 17 is provided, as depicted in FIG. 2. The joint connector arrangement 17 in this case includes two abutment pieces 18, 19 that have identical constructions, making explanation of one of the two abutment pieces 18, 19 sufficient. Corresponding structural elements of the two abutment pieces 18, 19 are provided with the same reference symbols.

The abutment piece 18 in this case is a flat, block-shaped structure that is bounded by a flat top side 21 and a parallel bottom side not visible in the figure, two long narrow sides 22, 23, and also two end faces 24, 25. The edges of the abutment piece 18 are beveled, as shown, so that they do not interfere with the round internal corners of the hollow space 8.

The distance of the two narrow sides 22, 23 from each other corresponds to the open distance between the two narrow sides 9, 11 of the lower flange 2. Thus, the transverse dimension of the abutment piece 21 is set so that this fits between the two narrow sides 9, 11 of the lower flange 2 with minimal lateral play.

The distance between the top side 21 and the bottom side corresponds to the open distance between the bottom side 12 and the top side 13 of the lower flange 2, so that the abutment piece 21 also has almost no vertical play in the hollow space 8. The abutment piece 18 can be shifted longitudinally in the hollow space 8 with practically no play in the transverse direction.

Attachment means 26 are provided for attaching the abutment piece 18 in the hollow space 8. In the embodiment shown, the attachment means include a total of four blind boreholes 27, which are configured as threaded holes, and which are provided with a counterbore at their end opening out into the narrow side 22 or 23. The longitudinal axis of the blind boreholes 27 lies parallel to the flat sides 21 and parallel to the end faces 24 and 25.

Furthermore, the attachment means 26 in this instance further includes cap screws 28 which can have, as will become apparent, a head 29 used as an alignment pin. The depth of the counterbore in the blind boreholes 27 is dimensioned so that the screw head 29 projects slightly above the respective narrow side 22, 23 when the screw is screwed into the blind hole 27 until the bottom side of the screw head 29 contacts the base of the counterbore. The projection that the screw head 29 exhibits after tightening is slightly less than the material thickness of the plate from which the running rail 1 is produced.

In order that the two abutment pieces 18, 19 align precisely in the assembled state and the abutting running rails 1 are forced into the correctly aligned position in the area of the lower flange 2, each abutment piece 18, 19 contains two cylindrical centering blind boreholes 31 in each respective end face 24, 25. Due to the perspective of FIG. 2, only the cylindrical blind boreholes 31 in the end faces 25 can be seen. Similar blind boreholes lie in the opposite end face 24. They are arranged so that they align precisely with each other when the end faces 24, 25 of adjacent abutment pieces 18, 19 lie congruent with each other.

The centering boreholes 31 are used for receiving alignment pins 32. The alignment pins 32 can either be loose or alternatively can be connected to one of the two abutment pieces 18, 19 by means of an interference fit in the corresponding centering borehole 31. For example, the right centering pin 32 can be seated with an interference fit in the top right centering borehole 31 of the abutment piece 19 (as viewed in FIG. 2), while the left alignment pin 32 is pressed into a centering borehole 31 on the adjacent end face 24 of the abutment piece 18. The corresponding centering boreholes 31 on the opposing abutment piece 18, 19 have appropriate tolerances so that the projecting end of the respective alignment pin 32 fits with a close sliding fit. This simplifies the assembly because there are no loose parts.

Figure 4:
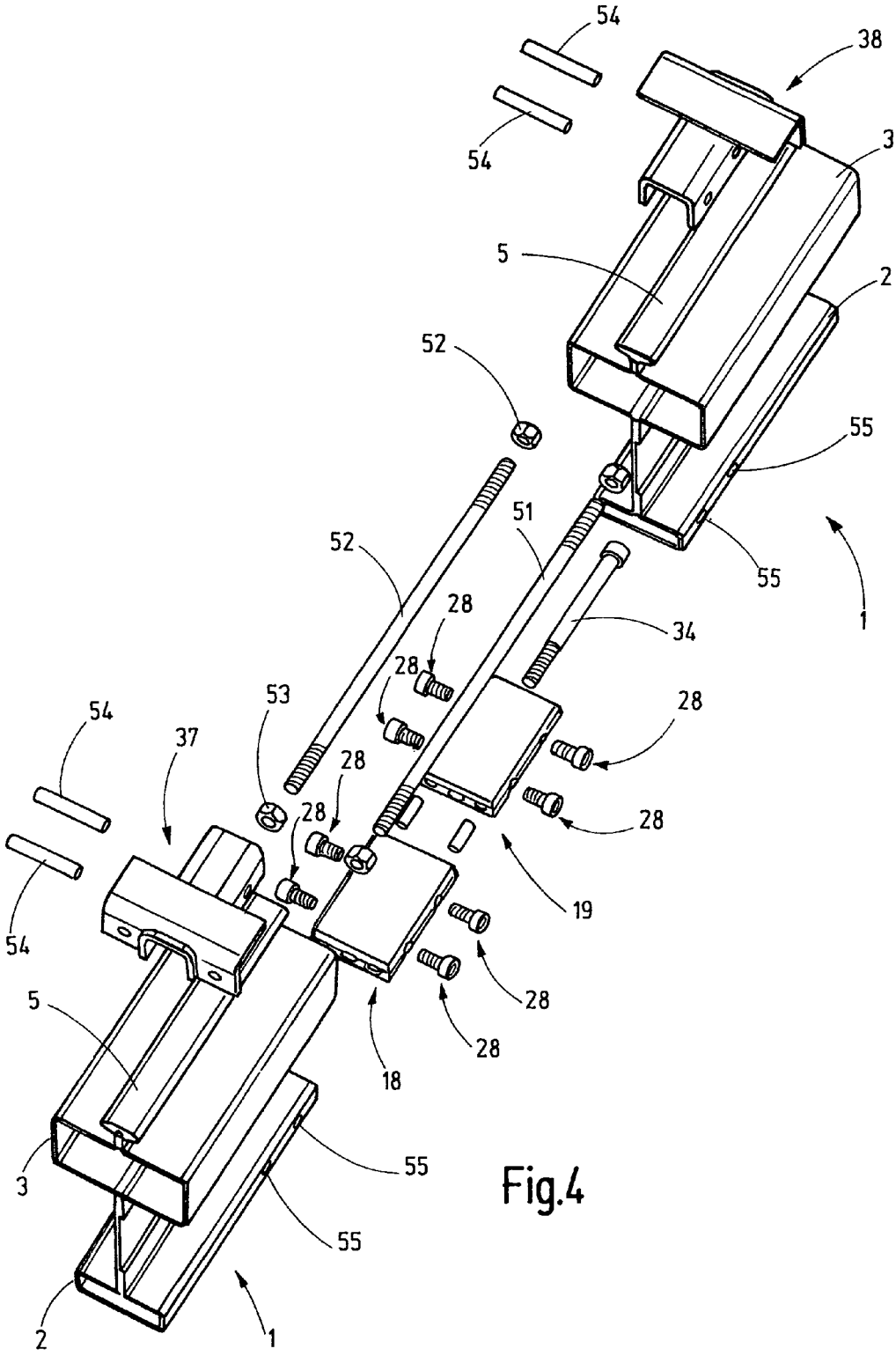
FIG. 4 is an exploded perspective of a rail joint with the rail joint connectors according to the invention associated with both the upper and lower flanges.

Through each of the two abutment pieces 18, 19 passes a through hole 33 that is perpendicular to the end faces 24, 25 and extends through the abutment piece 18, 19 over its length. The borehole 33 lies centered between the centering boreholes 31 to which it is axis parallel and is used to receive a tension rod in the shape of a long bolt 34, as depicted in FIG. 4.

Figure 3:
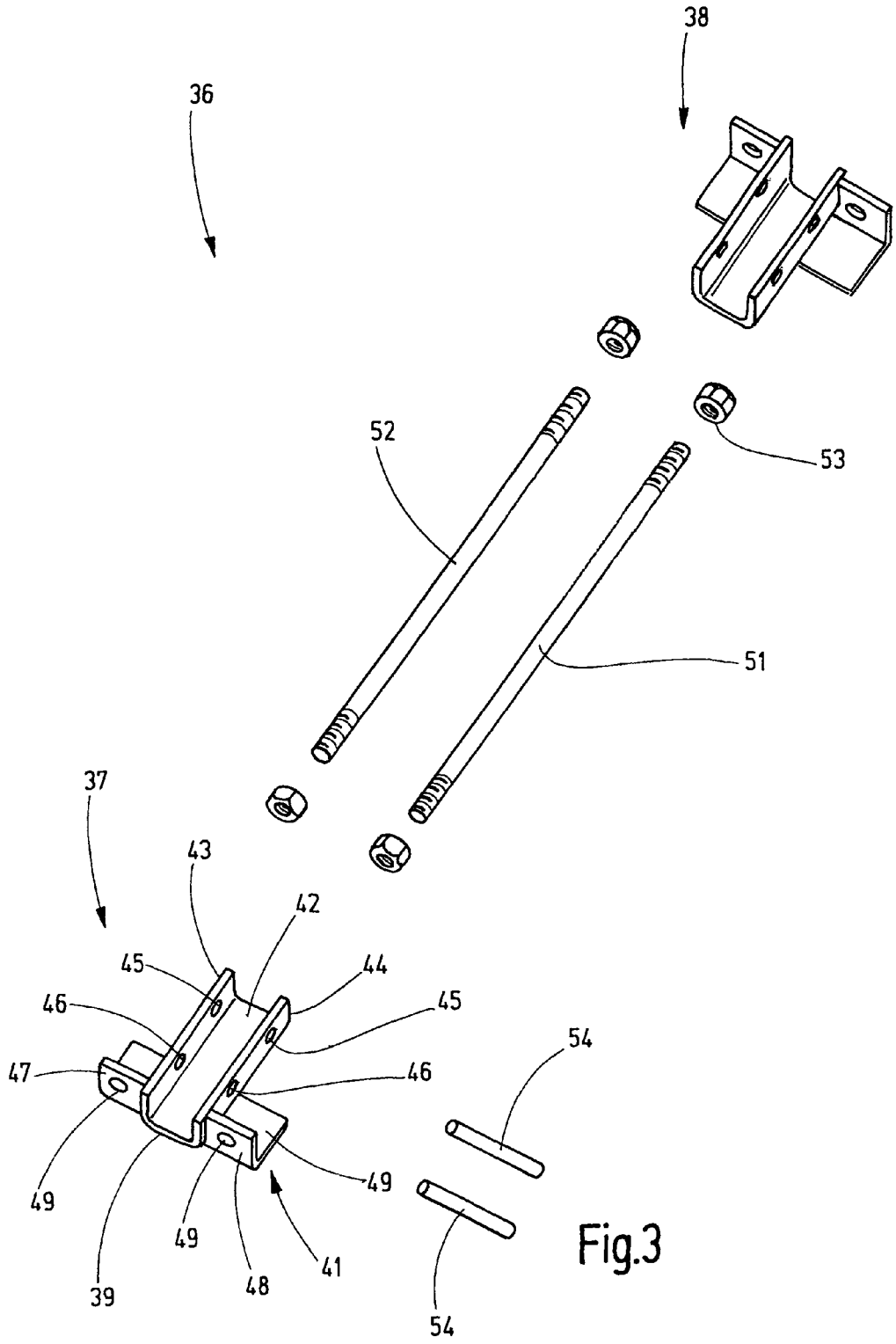
FIG. 3 is a rail joint connector arrangement for connecting the upper flanges of adjacent abutting rails.

While the joint connector arrangement 17 illustrated in FIG. 2 is used for connecting two running rails 1 in the area of the lower flange 2, FIG. 3 shows a rail connector arrangement 36 for drawing the two rails together at the joint in the area of their top side. In this case, two identical abutment pieces 37, 38 form part of the joint connector arrangement 36. Each abutment piece 37, 38 is delivered by a U-profile piece 39 and an angle piece 41 connected to the profile piece 39. The U-profile piece forms a back 42 from which two parallel legs 43, 44 project. The legs 43, 44 are formed with borehole pairs 45, 46 that are aligned with each other.

The angle piece 41 is positioned over the U-profile piece 39, as shown, and has two laterally projecting flanges 47, 48 that are connected to each other by a leg 49 of the angle profile 41 adjacent the back side 42 of the U-profile piece. The entire arrangement is a welded construction. Boreholes 50 are provided in the two flanges 47, 48. In order to connect the two abutment pieces 37, 38 to each other, threaded rods 51, 52 extend through the boreholes 50 onto which nuts can be screwed. For anchoring the abutment pieces 37, 38, cylindrical pins 54 are insertable through boreholes 45, 46.

Assembly of the two running rails 1 will now be explained with reference to FIG. 4:

The two running rails 1 are provided with ends that face each other end in the region of the abutment. A total of four boreholes 55 exist in the area of the side walls 9, 11, with the spacing of the boreholes 55 corresponding to the spacing of the threaded blind holes 27 in the abutment piece 18 or 19. In addition, the running rail 1 has a rectangular notch in the area of the bottom side 12, whose exact position of which will be apparent below. Furthermore, the two running rails 1 are provided with through holes in the bar-shaped web 15, whose spacing corresponds to the spacing of the hole pairs 45, 46 of the abutment pieces 37, 38, the positions of which will become apparent below. The two running rails 1 are thus prepared for the attachment of the rail connector arrangements 17, 36.

Now, in the exemplary embodiment shown in FIG. 4, the abutment piece 19 is inserted into the running rail 1 coming from the top right. This abutment piece 19 has previously been provided with the tensioning bolt 34 so that after insertion of the abutment piece 19, the bolt 34 projects from the top right running rail 1 in the direction toward the left bottom running rail 1 as viewed in FIG. 4. The abutment piece 19 is placed so that the threaded boreholes 27 contained in this abutment piece align with the boreholes 55 in the side walls 9, 11. The screws 28 can then be screwed into these boreholes 55 until they contact the base of the counterbore with their heads 29. The heads 29 now project into the boreholes 55 with little play and without projecting outward beyond the outer boundary of the lower flange 2. In such secured position, the end face 25 of the abutment piece is set back slightly inward relative to the end face of the running rail 1.

Similarly, the left bottom running rail 1 is equipped with the abutment piece 18 and is secured there by screwed-in screws 28. Now the running rails 1 are joined at the joint, wherein the bolt 34 penetrates into the through hole 33 of the abutment piece 18. Once the two running rails 1 contact each other sufficiently closely, the threaded end of the bolt 34 projects from the end face 25 of abutment piece, and a corresponding nut can be screwed onto it. For this purpose, appropriate rectangular openings 60 are provided in the bottom side 12 of the lower flange 2 as indicated above. Their position is selected so that both the head of the bolt 34 and also the nut to be screwed onto it are accessible with the help of tools.

Before the final assembly, the alignment pins 32 were inserted into the mating holes 31 to force a correctly aligned positioning of the two abutment pieces 18, 19 at the end faces adjacent to the rail joint. By tightening the nut on the bolt 34, the two abutment pieces 18, 19 are tightened together, and, thus, at the same time, the two guide rails 1 are also tightened together in the area of the joint.

From the foregoing, it can be seen that the boreholes 55 must be formed so that the abutment pieces 18, 19 do not project with their respective end faces 24, 25 beyond the free end face of the running rail 1 in which they are inserted. Otherwise, they would prevent the end faces of the two running rails 1 from making gap-free contact with each other. Through the appropriate selection of the position of the boreholes, with the help of the abutment pieces 18, 19 and the centering pins 32, the free ends of the two running rails 1 are pressed against each other in the area of their end faces so that the joint is gap-free and the outer edges of the lower flange 2 of the two running rails 1 transition smoothly, one to the other, steplessly.

When the assembly has been performed up to this point, the two abutment pieces 37, 38 are placed over the support rib 5 of each of the two running rails 1 from above, as the exploded-view in FIG. 4 illustrates. The two abutment pieces 37, 38 are secured on the respective running rail 1 by means of the cylindrical pins 54 that are seated in the hole pairs 45, 46 and are directed through corresponding boreholes formed in the bar-shaped web 15, as mentioned above. The U-profile pieces 39 of the abutment pieces 37, 38 ride on the support rib 5. The legs 43, 44 next to the support rib 5 extend toward the top side of the upper flange 3. Now, the threaded rods 51, 52 can be inserted through the boreholes 49 of the two abutment pieces 37, 38, and the nuts 53 can be tightened. In this way, the two running rails 1 are also tensioned in the region of their top side. Their free end faces again contact each other without a gap.

The two running rails 1 can now be loaded on both sides of the joint, wherein, by virtue of the two joint connector arrangements 17 and 36, vertical forces are transferred across the rail joint as if the two running rails 1 were integrally-formed in the area of the rail joint. In particular, bending forces directed both upward and downward are transferred across the joint.

The separation of the two abutment pieces 37, 38 and the tension rods 51, 52 is sufficiently large in the assembled state that the support rib 15 can be assessed between them with a suspending bracket. Such a suspending bracket is explained in detail, for example, in DE 10 2006 054 682.

Instead of the bolt 34 together with the two smooth through holes 33 in the two abutment pieces 18, 19, a threaded rod can also be used that has opposite ends threaded of equal pitch, but in an opposite rotational sense, in the manner of a turnbuckle. Accordingly, the borehole 33 in the abutment piece 18 is provided, for example, with a right-handed thread, and the borehole 33 in the abutment piece 19 is provided with a left-handed thread. By rotating this screw in the same way as described above, the two abutment pieces 18, 19 can be moved relative to each other to press the free end faces of the two running rails 1 against each other with no gap.

A joint connector for the lower flange of a running rail is assembled from two abutment pieces seated in the lower flange. With the help of centering devices, the correctly aligned positioning of the two abutment pieces is assured, wherein these abutment pieces transfer this positioning to the lower flange so that the lower flanges meet each other without offset at the joint, and the positioning cannot be negatively affected by transverse forces. In the transverse direction, the connection is, thus, a positive-fit connection with respect to the rail, by means of the abutment pieces. Another joint connector arrangement connects the two running rails in the region of the top side. Abutment pieces that are seated as riders on a support rib and connected to each other by tension rods are also used here.

The invention claimed is:

1. A rail joint connector arrangement for connecting rail joints in rails (1) for overhead conveyors comprising a pair of rails (1) each having a lower flange (2) formed with a hollow chamber, said chambers each being circumferentially closed without any elongated opening extending the length thereof, a first abutment piece (18, 19) insertable into the lower flange chamber of a first rail located on one side of the rail joint, said first abutment piece having an end face (24, 25) facing the rail joint, an attachment device (27, 28) for anchoring the first abutment piece (18, 19) in the lower flange (2) of the first rail, a second abutment piece (18, 19) insertable into the lower flange chamber of a second rail located on an other side of the rail joint, said second abutment piece (18,19) having an end face (24, 25) facing the rail joint, an attachment device (27, 28) for anchoring the second abutment piece (18, 19) in the lower flange chamber (2) of the second rail located on the other side of the rail joint;

a tensioning device (34) disposed with said flange closed chambers for selectively drawing the two abutment pieces (18, 19) together against each other, and at least one of said rails being formed with an opening less than the length of the rail and sized for selectively receiving a tool from outside the rail for enabling selected adjustable tensioning of the tensioning device.

2. The rail joint connector arrangement of claim 1 in which said two abutment pieces (18, 19) are identical to each other.

3. The rail joint connector arrangement of claim 1, in which each said abutment piece (18, 19) has the shape of a block with two side faces (22, 23) that are parallel to each other and two end faces (24, 25) that are parallel to each other.

4. The rail joint connector arrangement of claim 3, in which said device attachment device (27, 28) includes at least two boreholes (27) formed in the side faces (22, 23) of the abutment piece (18, 19) for anchoring the abutment piece (18, 19) in the lower flange (2) of the respective rail.

5. The rail joint connector arrangement of claim 4, in which said boreholes (27) are threaded boreholes.

6. The rail joint connector arrangement of claim 5 in which two said threaded bore holes (27) are sections of a continuous borehole.

7. The rail joint connector arrangement of claim 3 in which said boreholes (27) are counterbored.

8. The rail joint connector arrangement of claim 1, in which the abutment pieces (18, 19) each have a cross section transverse to a longitudinal axis of the respective rail (1) that corresponds to a cross section of the hollow chamber (8) in the lower flanges (2) of the respective rail.

9. The rail joint connector arrangement of claim 1, in which said abutment pieces (18, 19) each has beveled edges.

10. The rail joint connector arrangement of claim 1, in which said attachment device (27, 28) for anchoring each abutment piece (18, 19) in the lower flange (2) of the respective rail includes pins (28) that are insertable through side walls (9, 11) of the lower flange (2) into openings (27) of the abutment piece (18, 19).

11. The rail joint connector arrangement of claim 10, in which said pins (18) are screws.

12. The rail joint connector arrangement of claim 11, in which said screws (28) are stud bolts or cap screws.

13. The rail joint connector arrangement of claim 1, in which said centering device (31, 32) includes a centering borehole (31) and an alignment pin (32) in each abutment piece.

14. The rail joint connector of claim 13 in which the centering device (31,32) for each abutment piece includes an alignment pin (32) and a bore hole (31) in a respective end face of the abutment piece, with the alignment pin of each abutment piece being insertable into the bore hole of the other alignment piece.

15. The rail joint connector arrangement of claim 1 in which said tensioning device (33,34) of each abutment piece includes a through hole (33) extending through the abutment piece in a longitudinal direction of the respective rail.

16. The rail joint connector arrangement of claim 15 in which said tensioning device includes a tension rod that extends through holes in the abutment pieces (18,19).

17. The rail joint connector arrangement of claim 15 in which said tensioning device (33,34) includes a threaded tension rod that extends through holes of the abutment pieces (18,19).

18. The rail joint connector arrangement of claim 17 in which said abutment pieces each are formed with a respective tension rod receiving bore hole, and the bore hole of one abutment piece has a right hand thread and the bore hole of the other abutment piece has a left hand thread.

19. The rail joint connector arrangement of claim 18 in which said tension rod is threaded at opposite ends and has a projecting piece intermediate its ends for a turning tool.

20. The rail joint connector arrangement of claim 1 including a centering device (31,32) on the end face (24,25) of each abutment piece facing the rail joint for aligning the abutment pieces (18,19) relative to each other and thereby aligning ends of the rails (1) at the rail joint relative to each other.

21. A rail joint connector arrangement for connecting rail joints in rails (1) for overhead conveyors comprising a pair of rails (1) each having an upper flange (3) with a support rib (5) on a top side of the upper flange (3), a first abutment piece (37, 38) attachable to the support rib (5) of a rail first located on one side of the rail joint, an attachment device (45, 46, 54) having a pair of laterally spaced projecting flanges (43,44) for anchoring the first abutment piece (37, 38) on the support rib (5) of the first rail, a second abutment piece (37, 38) attachable to the support rib (5) of a second rail located on the other side of the rail joint, a second attachment rail device (45, 46, 54) for anchoring the second abutment piece (37, 38) on the support rib (5) of the second rail, a tensioning device (51, 52) for drawing the two abutment pieces (37, 38) toward each other.

22. The rail joint connector arrangement of claim 21, in which each abutment piece (37, 38) is formed with a channel that receives a respective support rib (5).

23. The rail joint connector arrangement of claim 21 in which each abutment piece (37, 38) is formed with boreholes (45, 46) oriented in a direction transverse to the support rib (5).

24. The rail joint connector arrangement of claim 21 in which said tensioning device (51, 52) includes at least one threaded rod that extends laterally adjacent to the support rib (5) connecting abutment pieces (37, 38).

25. A rail joint connector arrangement for connecting rail joints in rails (1) for overhead conveyors comprising a pair of rails (1) each having a lower flange (2) formed with a hollow chamber and an upper flange (3) formed with a support rib (15) on a top side thereof, a first abutment piece (18, 19) insertable into the lower flange chamber of a first rail located on one side of the rail joint, said first abutment piece having an end face (24, 25) facing the rail joint, an attachment device (27, 28) for anchoring the first abutment piece (18, 19) in the lower flange (2) of the first rail, a second abutment piece (18, 19) insertable into the lower flange chamber of a second rail located on an other side of the rail joint, said second abutment piece (18,19) having an end face (24, 25) facing the rail joint, an attachment device (27, 28) for anchoring the second abutment piece (18, 19) in the lower flange chamber (2) of the second rail located on the other side of the rail joint;

a tensioning device (34) drawing the first and second two abutment pieces (18, 19) together against each other, a third abutment piece (37,38) attachable to the support rib (5) of the rail first located on one side of the rail joint, said third abutment piece having a pair of laterally spaced projecting flanges disposed on opposite lateral sides of the support rib of the first rail, an attachment device (45,46,54) for anchoring the flanges of the third abutment piece (37,38) to the support rib (5) of the first rail, a fourth abutment piece (37,38) attachable to the support rib (5) of the second rail located on the other side of the rail joint, said fourth abutment piece having a pair of laterally spaced flanges disposed on opposite sides of the support rib of the second rail, an attachment device (45,46,54) for anchoring the flanges of the second abutment piece (37,38) to the support rib (5) of the second rail, and a tensioning device (51,52) for drawing the third and fourth abutment pieces (37,38) toward each other.

* * * * *